US009693141B2

(12) United States Patent
Sprinkle

(10) Patent No.: US 9,693,141 B2
(45) Date of Patent: Jun. 27, 2017

(54) FLUTED AND ELONGATED APERTURE FOR ACOUSTIC TRANSDUCER

(71) Applicant: Harman International Industries, Incorporated, Stamford, CT (US)

(72) Inventor: Charles Sprinkle, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 14/596,670

(22) Filed: Jan. 14, 2015

(65) Prior Publication Data

US 2015/0201279 A1 Jul. 16, 2015

Related U.S. Application Data

(60) Provisional application No. 61/927,412, filed on Jan. 14, 2014.

(51) Int. Cl.

| | |
|---|---|
| ***H04R 1/02*** | (2006.01) |
| ***H04R 7/04*** | (2006.01) |
| ***H04R 1/34*** | (2006.01) |
| ***H04R 1/00*** | (2006.01) |

(52) U.S. Cl.

CPC ..... *H04R 7/04* (2013.01); *H04R 1/00* (2013.01); *H04R 1/345* (2013.01); *H04R 1/023* (2013.01)

(58) Field of Classification Search

USPC ..... 381/339, 340

See application file for complete search history.

(56) References Cited

U.S. PATENT DOCUMENTS

| | | | | |
|---|---|---|---|---|
| 2,271,100 | A | 1/1942 | Scott | |
| D724,569 | S | 3/2015 | Sprinkle | |
| 2005/0276431 | A1 | 12/2005 | Moore | |
| 2009/0310808 | A1* | 12/2009 | Button et al. | 381/339 |
| 2011/0168480 | A1* | 7/2011 | Sterling | H04R 1/345 181/176 |

FOREIGN PATENT DOCUMENTS

JP H01226298 A 9/1989

OTHER PUBLICATIONS

Hardwood, H.D. et al., "The design of studio monitoring loudspeakers types LS5/5 and LS5/6", Technological Report No. PH-13, BBC Engineering Division, Research Department, Jan. 1967, 24 pages.

Hardwood, H.D. et al., "Aspects of High-quality Monitoring Loudspeakers", Monograph No. 78, BBC Engineering Division, Jan. 1969, 18 pages.

Hardwood, H.D., "New B.B.C. Monitoring Loudspeaker—1. Design of the low frequency unit", Wireless World, Mar. 1968, 13 pages.

European Patent Office, Extended European search report of 15150551.8, May 5, 2015, Germany, 6 pages.

* cited by examiner

*Primary Examiner* — Amir Etesam

(74) *Attorney, Agent, or Firm* — McCoy Russell LLP

(57) ABSTRACT

Embodiments are disclosed for a loudspeaker for producing directed acoustic vibrations. In some embodiments, a loudspeaker includes an electromagnetic transducer including diaphragm configured to generate acoustic vibrations. The loudspeaker may further include an aperture positioned in front of the diaphragm in a direction of propagation of the acoustic vibrations, the aperture including an opening having one or more protrusions forming an opening shape having non-uniform edges.

20 Claims, 12 Drawing Sheets

FLUTED AND ELONGATED APERTURE FOR ACOUSTIC TRANSDUCER

CROSS REFERENCE TO RELATED APPLICATIONS

This application claims priority to U.S. Provisional Patent Application No. 61/927,412, entitled "FLUTED AND ELONGATED APERTURE FOR ACOUSTIC TRANSDUCER," filed Jan. 14, 2014, the entire contents of which are hereby incorporated by reference for all purposes.

FIELD

The disclosure relates to electromagnetic transducers and particularly to loudspeakers.

BACKGROUND

In a transducer, energy of one form is converted to energy of a different form. Electroacoustic transducers convert electrical impulses to acoustic vibrations that may be perceived as audible sound to proximate listeners. Conventional electroacoustic transducers, or speaker drivers, include a conical diaphragm and frame with the magnetic sound-producing components mounted to the small end of the cone, leaving the large end of the cone open. Some conical speaker arrangements include an aperture placed over the large end of the cone for the purpose of directing sound waves according to the speaker system requirements.

SUMMARY

Embodiments are disclosed for a loudspeaker for producing directed acoustic vibrations. In some embodiments, a loudspeaker includes an electromagnetic transducer including diaphragm configured to generate acoustic vibrations. The loudspeaker may further include an aperture positioned in front of the diaphragm in a direction of propagation of the acoustic vibrations, the aperture including an opening having one or more protrusions forming an opening shape having non-uniform edges.

In additional or alternative embodiments, a loudspeaker includes an electromagnetic transducer including a diaphragm configured to generate acoustic vibrations and an aperture positioned in front of the diaphragm in a direction of propagation of the acoustic vibrations, the aperture including a single opening that is symmetric about two perpendicular axes, the opening including one or more protrusions extending from a center of the opening.

In still further additional or alternative embodiments, a loudspeaker includes an electromagnetic transducer including a diaphragm configured to generate acoustic vibrations, and an aperture positioned in front of the diaphragm in a direction of propagation of the acoustic vibrations, the aperture including a single opening that is symmetric about two perpendicular axes. The opening may include six protrusions extending from a center of the opening, three of the six protrusions positioned on each side of a horizontal axis through a center of the opening, and a first and second central protrusion of the six protrusions positioned along a vertical axis through the center of the opening, where the apex of each of the first and second central protrusions coincides with the vertical axis.

BRIEF DESCRIPTION OF THE DRAWINGS

The disclosure may be better understood from reading the following description of non-limiting embodiments, with reference to the attached drawings, wherein below.

DETAILED DESCRIPTION

Figure 1:
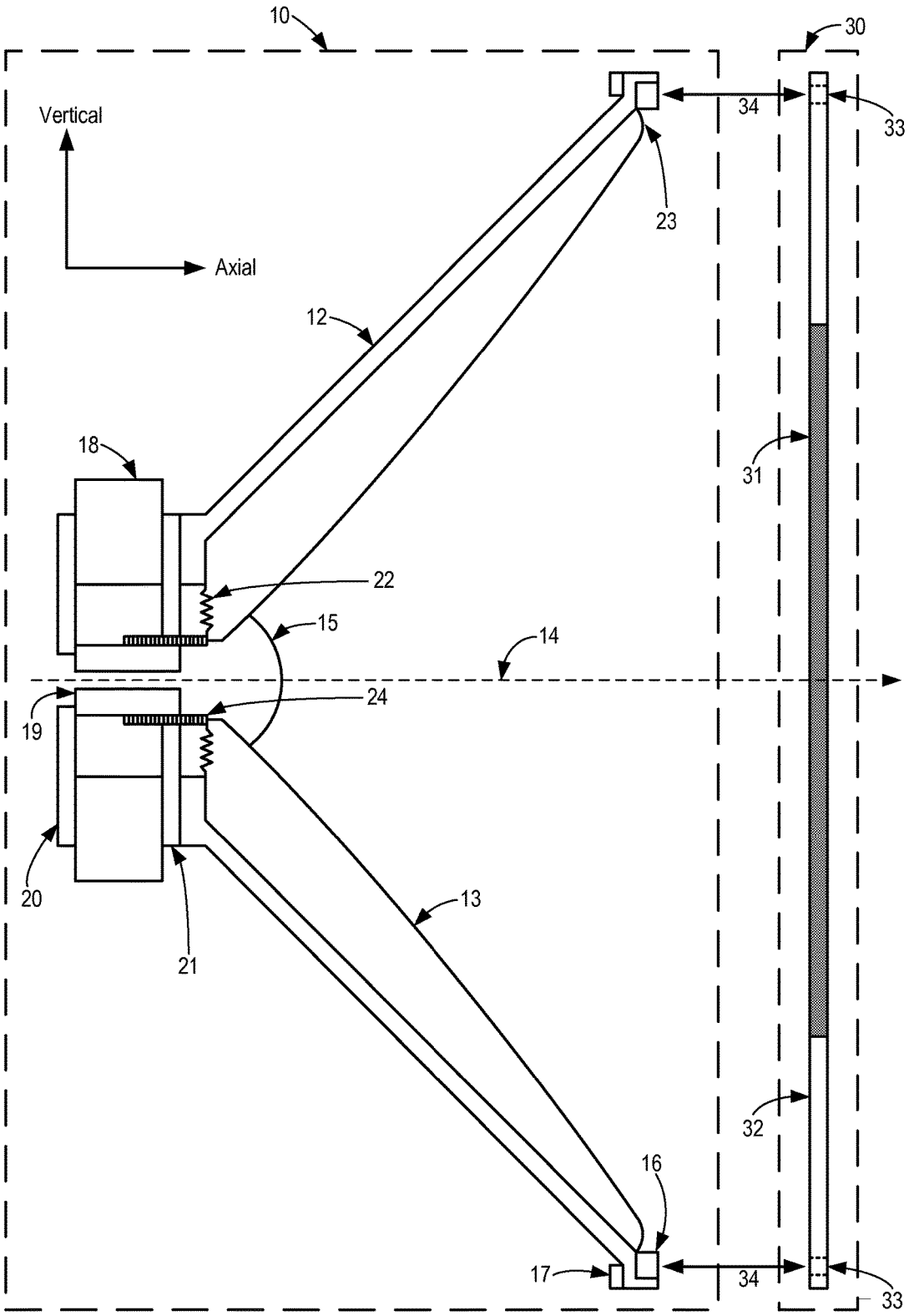
FIG. 1 shows a cross-sectional view of a conventional dynamic loudspeakers with an aperture in accordance with one or more embodiments of the present disclosure.

One type of loudspeaker (or driver) is a moving coil electrodynamic piston driver, also known as a dynamic loudspeaker. A general cross-section of this speaker is shown in FIG. 1 as speaker 10. The speaker 10 has a cylindrical shape about a central axis, labelled as axis 14 in FIG. 1. As such, the axis 14 represents the axial direction of the speaker. Since the speaker is symmetrical about the central axis 14, it is to be understood that the components above and below the axis are identical.

The conventional dynamic loudspeaker utilizes a number of components to produce sound. It is noted here that the components shown in FIG. 1 may be included in many types of dynamic loudspeakers, but other loudspeakers may include more or fewer components than those that are illustrated. The general outside shape of speaker 10 is defined by a conical diaphragm 13 that adjacent to a frame 12. The diaphragm 13 may be a thin, lightweight piece that is usually made of paper, plastic, or metal while the frame 12 may be rigid and made of thicker metal relative to the diaphragm in order to provide a support structure for the diaphragm and other speaker components.

The diaphragm 13 may be supported by a suspension system to allow the diaphragm to move in an axial direction while remaining flexibly connected to the frame 12. The suspension system may comprise a spider 22 and surround 23. The surround 23 is a rim of flexible material that attaches the diaphragm to the frame (or basket) near the larger end of the speaker. Similarly, the spider 22 may be made of a corrugated material and attached to the frame and voice coil 24 located near the diaphragm, the function of which is explained below. The speaker 10, as illustrated, has an open back, referring to the frame being comprised of ribs and permitting air to fill and/or enter an area between the rear of the driver and the rear of the diaphragm.

A front gasket 16 and rear gasket 17 may be provided as mounting surfaces for attaching the speaker inside a speaker box (not shown). Depending on the speaker box configuration the front or rear gasket (16 or 17) may be used for mounting the speaker. The speaker may also include a dust cap 15 that covers the hole of the diaphragm 13, creating a seal between the inner structure of the driver and outside environment.

Near the smaller end of the diaphragm, the speaker may comprise a back plate 20, a front plate 21, and a center pole 19 that form the shape of the driver with the permanent magnet 18 rigidly sandwiched in between the back and front plate (20 and 21). The front and back plates primarily serve to provide structure for the driver and may also dissipate heat while sound is being produced. The central part of the speaker, the voice coil 24, may be suspended in a narrow, cylindrical gap in between the front plate and center pole. The voice coil 24 is centrally positioned by the spider 22, which also constrains the voice coil 24 to move axially through the gap. The voice coil is normally made of aluminum or copper and an electrical signal is passed through it. The electrical signal corresponds to the audio signal and is a representation of the original musical waveform.

When an electric current from an external source such as an amplifier is passed through the voice coil 24, an electromagnet is formed that interacts with the permanent magnet surrounding the periphery of the voice coil. The amplifier, or external source, rapidly reverses the electrical signal causing the polarity of the voice coil to rapidly reverse. The rapid reversal of polarity in turn causes the electromagnet and surrounding permanent magnet 18 to interact, thereby forcing the voice coil 24 and attached diaphragm 13 to move back and forth along the axial direction 14 of the speaker. The movement of the diaphragm vibrates the air in front of and behind the speaker, thereby creating propagating sound waves. The frequency of the vibrations controls the pitch of the produced sound and the amplitude affects the volume of the produced sound.

The speaker 10 and/or a housing comprising the speaker 10 may include an aperture 30 for directing sound emitted from the speaker 10. The aperture 30 may include an aperture frame 32 including solid material through which at least a portion of acoustic waves directed thereto are unable to pass. The aperture 30 may further include an opening or aperture shape 31 through which at least a portion of the sound emitted from the speaker 10 is able to pass. For example, the aperture shape may be completely open and/or covered in material that enables passage of acoustic waves. The aperture 30 may be mounted and/or coupled to the speaker 10 via connection 34, which may include connectors (e.g., screws, bolts, etc.) configured to pass through holes 33 and attach to the front gasket 16.

Other, similar speaker systems may include a number of different components not shown in FIG. 1, such as multiple voice coils and sealed drivers. The speaker 10 of FIG. 1 is a basic dynamic loudspeaker and is the subject of one or more embodiments of the present disclosure. Other dynamic loudspeakers, regardless of additional or absent components than those seen in FIG. 1, may function in the same general way by receiving an alternating electric current to vibrate a magnet and diaphragm to produce sound.

Throughout this disclosure, several types of dynamic loudspeakers may be referenced and/or utilized in combination with an aperture for directing sound. Drivers are categorized in a number of ways according to frequency ranges and names. A driver that produces low-mid frequency sounds generally around 300 Hz up to 5000 Hz is known as a mid-range speaker. A driver that produces low frequency sounds generally around 40 Hz up to 1000 Hz is known as a woofer. Woofers and mid-range drivers as described may be dynamic loudspeakers, utilizing a conical diaphragm, frame, and voice coil to produce sound as described above with reference to FIG. 1. A horn loudspeaker, similar to a dynamic loudspeaker, utilizes a small compression driver mounted to the small end of a flared duct. Sound is produced by the compression driver via a small metal diaphragm vibrated by an electromagnet. It is noted here that the above driver descriptions are presented to provide a basis for explanation of the present disclosure and are not to be regarded in a limiting sense.

Speaker systems are used in a variety of venues for providing sound to a multitude of people. Depending on the room size, number of listeners, type of performance or activity, and other factors, different speaker systems are used. One type of system is a portable pro audio (PA) system which is commonly used in smaller venues by disk jockeys and others who do not have a need for larger, full PA systems. Portable PA systems may be compact and lightweight for quick setup, easy transport, and high maneuverability relative to bulkier audio systems.

The speakers for portable PA systems may have two drivers in a single case, including a large woofer and a compression driver (e.g., a horn). Speakers that utilize two drivers are often referred to as two-way speakers. The woofer generally produces the low to midrange frequencies while the horn produces the higher frequencies. An example PA system, explained in further detail below, is shown as speaker 300 in FIG. 3.

Figure 2:
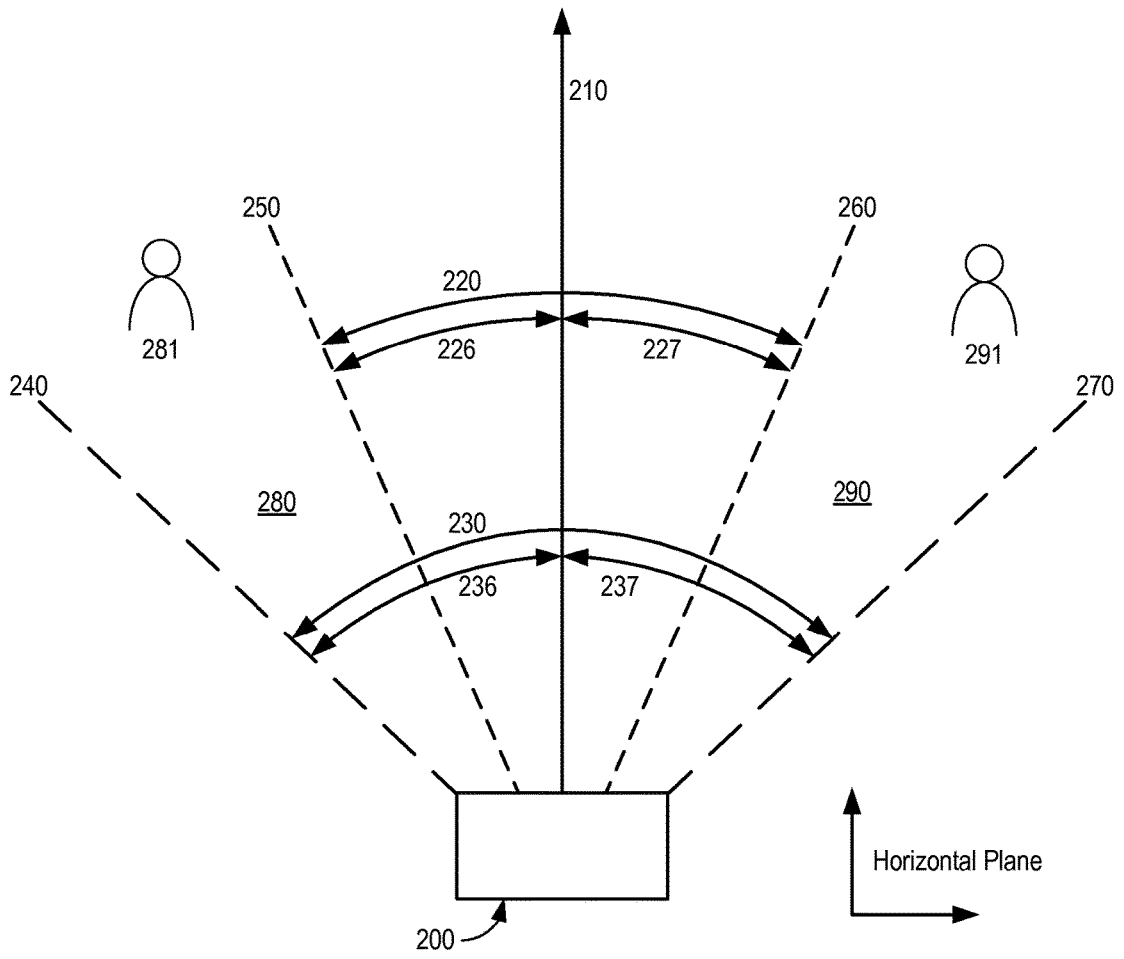
FIG. 2 shows the top view of a wide and narrow speaker coverage pattern in accordance with one or more embodiments of the present disclosure.

FIG. 2 shows a top view of a speaker 200 and directions in which it may produce sound. The directivity of the produced sound is a quality of speakers that may be measured by a numerical directivity index. More specifically, directivity is the ratio of the sound intensity radiated on-axis to the sound intensity that is radiated off-axis. On-axis sound refers to the sound that is emitted directly away from the speaker, shown as axis 210 in FIG. 2, while off-axis sound refers to the sound that is emitted at an angle away from the speaker. Off-axis may refer to any axis that is not axis 210, including but not limited to axes 240, 250, 260, and 270. As an example, a speaker with a high directivity index has a narrow coverage angle 220, where the one-dimensional coverage angle refers to the planar range of sound produced by the speaker. Conversely, a speaker with a low directivity index has a wide coverage angle 230, meaning a threshold sound pressure level is produced at a larger off-axis angle than a speaker with a high directivity index. It is noted here that two or more different coverage angles for a single speaker may exist, for example, one for the horizontal plane and another for the vertical plane.

Since the input electrical signal for a speaker may be separated into different frequency ranges suited to the woofer and driver, a crossover region exists where the highest frequency sounds of the woofer meet and overlap with the lowest frequency sounds of the horn. In the crossover region the transition from low to high frequencies takes place and vice versa. The fidelity of the sound may be increased and/or the distortion of the sound may be decreased when the directivity of the two transducers matches at the crossover region.

On low frequency drivers, as the output sound frequency increases, the wavelength of the sound reaches the dimension of the transducer, causing the directivity index to increase rapidly, thus also rapidly decreasing the coverage angle of the speaker. This causes the nominally omnidirectional sound of the driver to become very narrow. As an example, a 15 inch driver producing sound above 980 Hz has a rapidly-increasing directivity index.

At the same time, a high frequency driver has a lowest operation of about 1500-1600 Hz. In that frequency range with crossover around 1500-1600 Hz, the 15 inch woofer may have a 50 degree horizontal coverage angle while the horn may have a horizontal coverage angle as high as 90 degrees. The difference in coverage angles in the crossover region creates a directivity anomaly such that the directivity index is not constant across the crossover region, creating a non-uniform sound coverage across the listening area, thereby reducing the listening experience.

Visually, the 90 degree angle may be represented as the angle 230 between axes 240 and 270 of FIG. 2. Since FIG. 2 shows the horizontal plane, any vertical coverage pattern is not shown but understood to be in a plane orthogonal to the horizontal plane. The 90 degree angle is divided into two 45 degree angles, shown as angles 236 and 237. Similarly, the 60 degree angle may be represented as the angle 220 between axes 250 and 260, divided into two 30 degree angles, shown as angles 226 and 227. As can be seen in FIG. 2, the difference between coverage angles 220 and 230 creates listening areas that do not contain the full range of sound. The directivity anomaly may be experienced in areas 280 and 290, thus decreasing the audio quality experienced by audience members 281 and 291.

One method of matching the directivity indices is to reduce the coverage pattern of the horn down to match the woofer's coverage pattern. However, with this approach, the coverage angle may be reduced to very small angles such as 50 degrees, which creates a coverage pattern that may be too small for optimal sound production. Furthermore, the coverage pattern of the horn may be difficult to control.

An alternate approach to reducing the horn's coverage pattern may include altering the coverage pattern of the woofer by using an aperture. A speaker aperture is a solid piece of material that contains an orifice and may be fitted over an opening of the speaker. With some dynamic loudspeakers, such as the loudspeaker described with respect to FIG. 1, the driver includes a conical diaphragm attached to a rigid frame with the voice coil at the smaller apex of the cone. In this type of loudspeaker, the aperture may be placed over the larger apex of the cone. By placing the aperture over the driver, several sound elements can be altered, including the coverage pattern and directivity index as pertinent to the present disclosure. Without the aperture, the sound is emitted from the driver according to the circular shape of the larger apex of the cone. The aperture modifies the circular shape and thereby affects how the sound emerges from the cone and towards the listeners. An aperture configured as described below may be utilized to control the horizontal directivity of the woofer to match the HF horn with minimal adverse impact to the frequency response of the speaker system.

To match the coverage pattern of the horn, the woofer (such as a 15 inch driver) may be modified by an aperture to produce larger coverage in the horizontal plane and narrower coverage in the vertical plane. In portable PA systems, the horn may have a 90 degree coverage angle in the horizontal plane and a 60 degree coverage pattern in the vertical plane. The disclosure provides an aperture that may be narrower in one direction than a second, perpendicular direction. The aperture may be mounted such that the longer axis of the aperture lies in the vertical direction (e.g., the aperture may be longer along the height of the speaker) while the smaller axis of the aperture lies in the horizontal direction. By attaching the elongated aperture to the woofer in this manner, the woofer is effectively made narrower, thereby creating a wider horizontal coverage pattern and a narrower vertical coverage pattern. The aperture may thus be designed so as to control the horizontal directivity of the woofer to match the HF horn.

The main problem that arises with the use of apertures is that when an object is placed in front of the woofer opening, sound may reflect off the aperture edges back into the conical diaphragm chamber, creating resonance which can decrease the sound quality. In response to this issue, in addition to the narrow aperture, the aperture may be configured to include a number of fluted edges to smear the resonances in order to minimize their effect on the sound quality. The fluting refers to the edges of the aperture that are curved towards the small apex of the diaphragm cone (e.g., toward the center of the aperture). The boundary of the fluting may include either smooth curves or straight lines.

Figure 3:
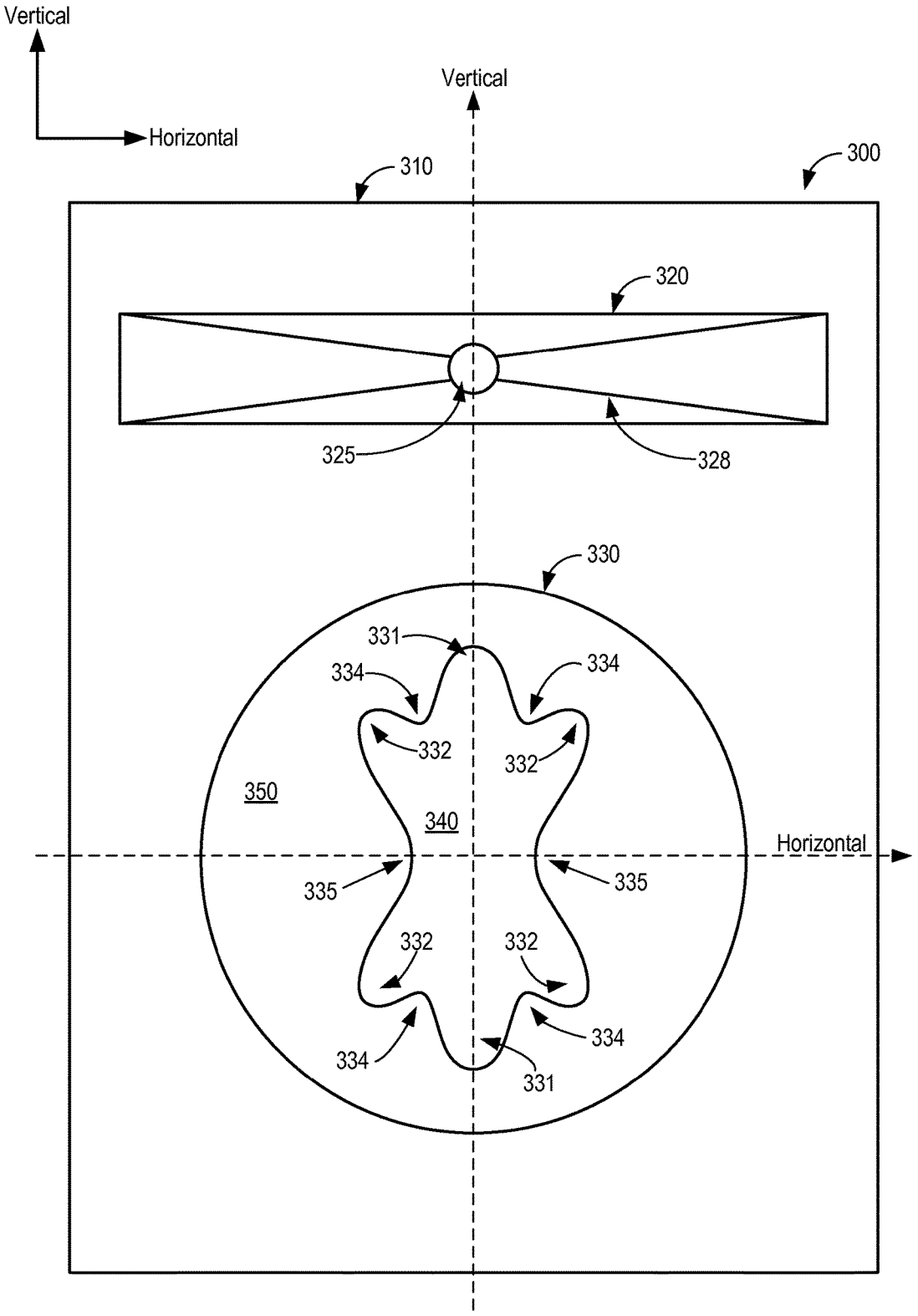
FIG. 3 shows a front view of a conventional two-way portable pro audio speaker with an aperture in accordance with one or more embodiments of the present disclosure.

FIG. 3 shows a front view of a general portable PA speaker system 300 with a horn 320 and woofer (not shown). In the embodiments described in further detail below, a circular aperture 330 is placed over a larger end of the conical diaphragm of the woofer, which is located behind the aperture 330 and is therefore obscured from view. The woofer is located inside a speaker box 310 which also contains the horn 320 to produce higher-frequency sounds.

The aperture 330 includes a solid, at least semi rigid frame 350 that may be composed of a material that is selected based on the acoustical properties of the speaker. The aperture frame 350 may include a cutout (e.g., removed material) that is hereafter referred to as the aperture shape 340, or the orifice through which sound waves outputted from the woofer travel with the least resistance relative to other locations on the aperture frame 350. The aperture 330 is a three-dimensional feature with uniform depth according to the thickness of the aperture frame material, but hereafter the shape 340 of the aperture will be treated as a two-dimensional geometric feature with no depth. The three-dimensional aspect of the aperture is created by the fluting (334 and 335) that curves towards the speaker driver, as previously described. In other words, the aperture frame 350 may not comprise a purely planar shape, such as a thin disk. Instead, the outer edge and peripheral of the aperture frame may be planar, but towards the center the fluting (334 and 335) that defines the aperture opening 340 may be curved towards the small end of the diaphragm cone. This three-dimensional feature changes the shape of the aperture frame 350 but does not alter the two-dimensional profile of the aperture. A relevant analogy is that a curved wall appears as a rectangle when viewing it from a side. The depth of the curved fluting and amount of the aperture border that is curved depends on the acoustical requirements of the woofer and entire speaker system.

Hereafter the fluting (334 and 335) will refer to only the aperture material that protrudes outside the plane of the aperture frame edges. In addition to the fluting, there are sections of removed material around the fluting that help define the fluting and its curvature. These sections of removed material (e.g., the absence of material) are hereafter referred to as protrusions (331 and 332). The combination of fluting (334 335) and protrusions (331 and 332) define the aperture shape 340 while the aperture frame 350 holds the aperture 330 to the larger apex of the speaker, in this case a woofer.

A vertical and horizontal axis shown in FIG. 3 defines the position of the aperture shape in relation to the aperture plate and woofer diaphragm. It is noted that the axes are arranged to form an origin that coincides with the center of the circular aperture frame 350.

In a first embodiment, the aperture shape is defined by a number of (e.g., one or more) protrusions and/or fluting of varying shapes and sizes. The protrusions and/or fluting may form at least one non-uniform edge of the aperture shape. The aperture shape may be elongated along the vertical axis such that its vertical axis length is larger than its horizontal axis length (or width). The aperture shape may comprise an elongated central body that has protrusions branching away from the body and away from the origin defined by the vertical and horizontal axes. The aperture shape may alternatively comprise a central body that has a same size and/or shape in a horizontal and a vertical axis (e.g., in perpendicular planes). The central body of the aperture shape and/or the overall aperture shape may have a length (e.g., may extend along a vertical axis) that is the same size as a width (e.g., extending along a horizontal axis) of the central body and/or overall aperture shape. For example, the longest protrusion(s) of the aperture shape in the horizontal plane may be the same length as the longest protrusion(s) of the aperture in the vertical plane.

The central body has a geometric center that coincides with the origin of the horizontal and vertical axes. For example, the central body may have an overall or inner oval/elliptical shape (e.g., the aperture shape may be configured such that an elliptical shape may be positioned within the aperture shape such that at least one portion of an outer periphery of the elliptical shape abuts material of the aperture frame 150 and no portion of the elliptical shape extends outside of the aperture shape), with one or more of the protrusions radiating and/or extending from a center of the oval shape. Alternatively, the central body may have an overall or inner circular/square shape (e.g., the aperture shape may be configured such that a circular shape and/or a square shape may be positioned within the aperture shape such that at least one portion of an outer periphery, edge, or corner of the circular shape and/or square shape abuts material of the aperture frame 150 and no portion of the circular shape and/or square shape extends outside of the aperture shape). The one or more protrusions may extend from a center of the circular and/or square shape in such examples. The protrusions may be curved, as shown in FIG. 3, straight, as present in an 'X' or multi-sided star shape, or a combination of curved and straight. The protrusions may be arranged or melded together in some embodiments in order to create an aperture shape that is similar to an outer periphery of an '8' or hourglass shape. The protrusions may be different from one another, and/or positioned in any suitable location around a periphery of the central body.

Figure 5:
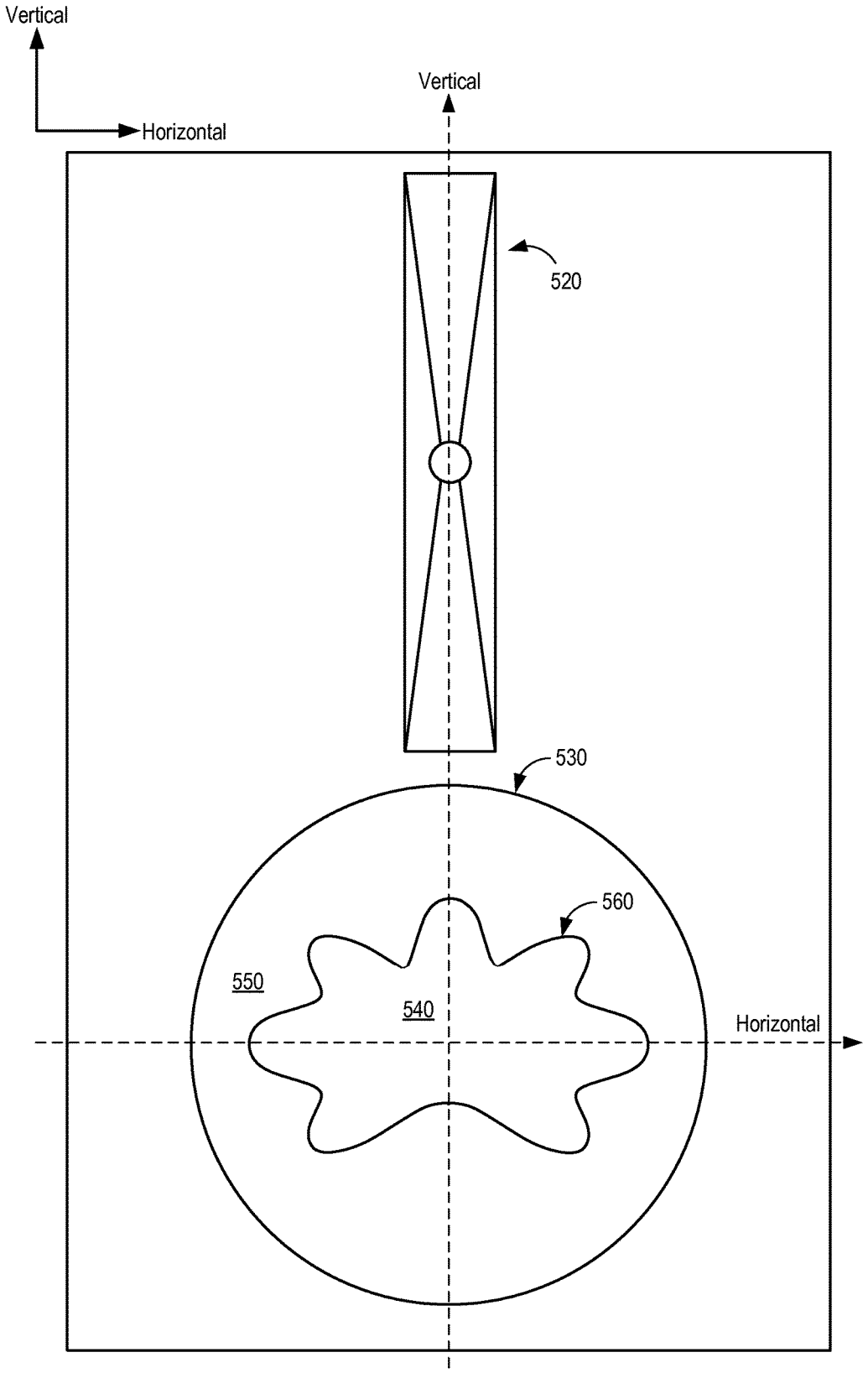
FIGS. 5-7 show examples of different aperture shapes in accordance with one or more embodiments of the present disclosure.
Figure 6:
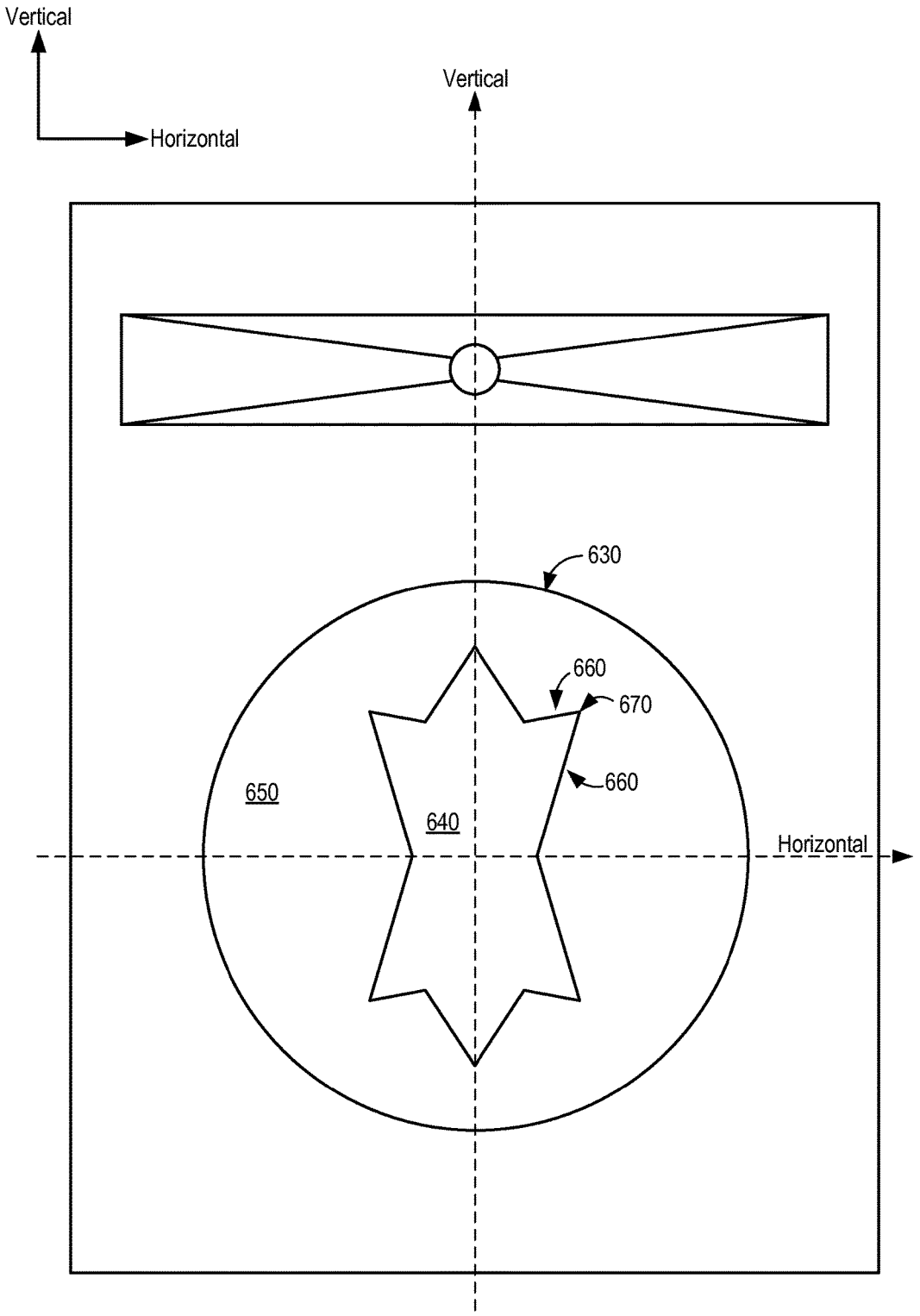
Figure 7:
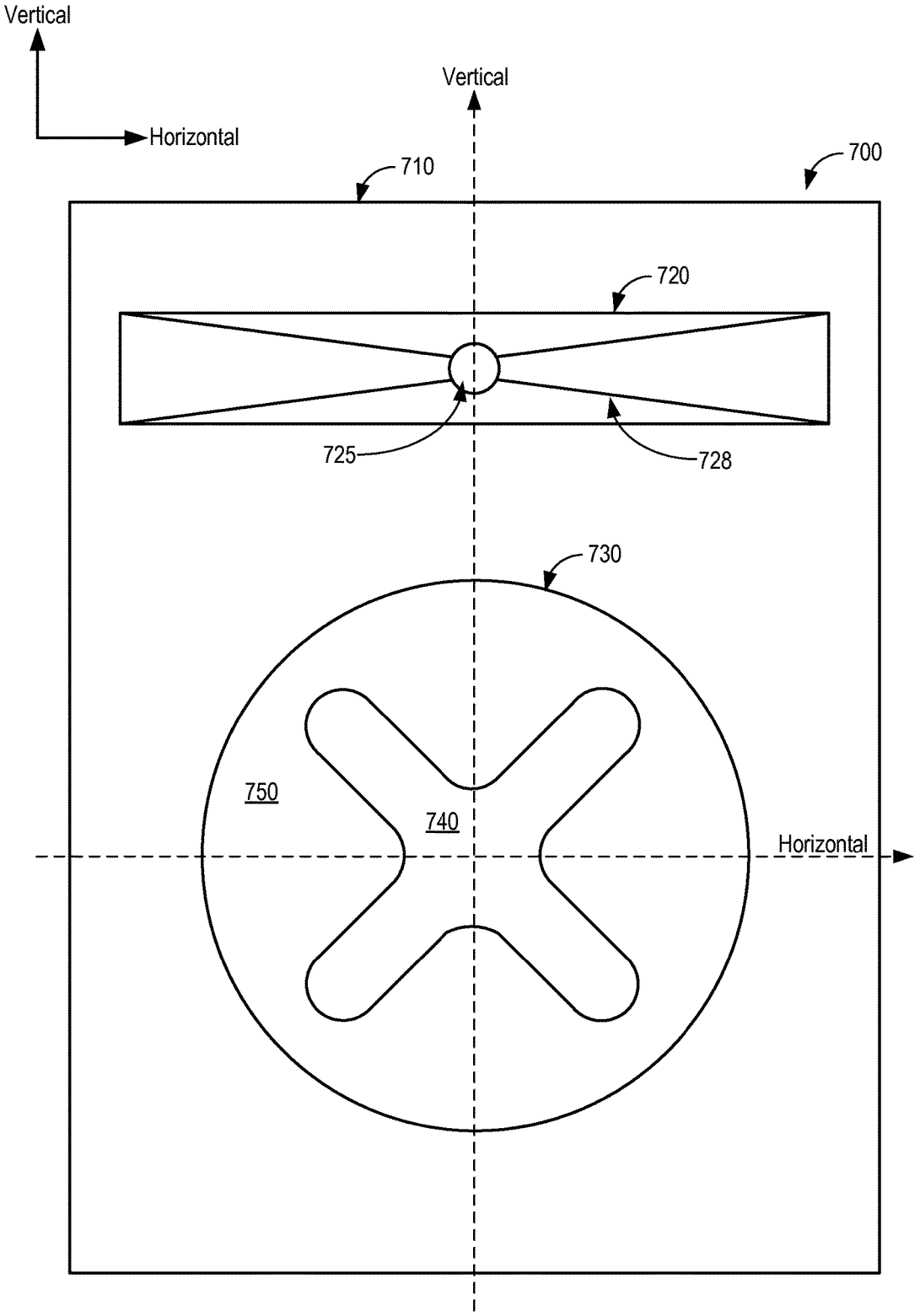

FIGS. 5-7 show examples of different aperture shapes and associated protrusions. For example, FIG. 5 illustrates an aperture shape 540 of an aperture 530, the aperture shape 540 being an opening in an aperture frame 550. The aperture shape 540 includes an odd number of protrusions 560 (e.g., three protrusions arranged near each end of the aperture along the horizontal axis and one protrusion near a top of the aperture along the vertical axis). Due to the arrangement of the protrusions, the aperture shape 540 is asymmetrical about the horizontal axis and symmetrical about the vertical axis. The aperture shape 540 is also wider along the horizontal axis than the vertical axis. The high frequency horn 520 of FIG. 5 is illustrated as being longer along the vertical axis than the horizontal axis, however it is understood that any suitable orientation of the high frequency horn 520 relative to the aperture shape 540 may be utilized.

FIG. 6 illustrates an aperture shape 640 of an aperture 630, the aperture shape 640 being an opening in an aperture frame 650. The example aperture shape 640 resembles a multi-sided star shape, in which the protrusions include straight edges 660 that meet at corners 670. FIG. 7 illustrates an aperture shape 740 of an aperture 730, the aperture shape 740 being an opening in an aperture frame 750. The example aperture shape 740 resembles an 'X' shape that is a same size in the vertical plane as the horizontal plane (e.g., the overall shape is not elongated in any one plane, the overall shape is as long as it is wide, and/or the longest protrusion in the vertical plane is as long as the longest protrusion in the horizontal plane).

In a second embodiment, the aperture is a single opening that is symmetric about the vertical and horizontal axes. Due to this symmetrical nature, the aperture has a well-defined, geometric center (or centroid). In this embodiment, the aperture centroid coincides with the origin defined by the intersection of the vertical and horizontal axes. As such, the center of the aperture also coincides with the center of the circle defined by the circular aperture frame.

In this embodiment, the aperture has a central, generally elliptical shape and is longer in length along the vertical axis than along the horizontal axis. The aperture has a number of protrusions that extend away from the elliptical shape to form smaller shapes that are positioned farther away from the origin than the elliptical shape. Each protrusion comprises a smooth curved shape and an apex. The apex is the point that is farthest away from the origin, and each protrusion includes a single apex. The edge of the aperture shape around the apex may be either rounded or straight.

The number of protrusions may be even in order to maintain balanced sound output from the speaker. Furthermore, the even number of protrusions may be arranged symmetrically about the horizontal and vertical axes of the aperture shape. Accordingly, upon dividing the aperture space around the horizontal and/or vertical axis to create two ends of the aperture shape, the same number of protrusions may be present in each end of the aperture shape and/or in the same position of the aperture shape relative to the axis along which the aperture shape is divided.

The aperture shape may not contain any sharp corners that could adversely affect the propagation of sound waves. Therefore, both the fluting and protrusions may comprise curves that have rounded intersections, and not intersecting points. The aperture shape may symmetrically curve towards the origin along at least one of the two axes, or along at least one angled line that passes through the origin. This curvature creates a section near the origin that appears pinched such that there is a shorter distance across the orifice, and that distance increases as the curvature moves away from the origin on either side of the line of symmetry.

In a third embodiment, the aperture shape has an appearance that is substantially similar to the aperture shape 340 illustrated in FIG. 3. For example, the aperture shape in this embodiment is again symmetric about the horizontal and vertical axes and is centrally arranged within the aperture frame 350 and woofer diaphragm as described with respect to the second embodiment. The boundary that defines the aperture shape may be comprised of curves and may not contain any sharp vertices, such as those on the corners of squares or other regular polygons. In this embodiment, the aperture shape 340 has six protrusions, three positioned on each side of the horizontal axis through the center of the aperture shape to form two sets of protrusions, maintaining symmetry. Similarly, fluting is present in between each protrusion such that there are six fluting pieces total. Two protrusions 331 lie along the vertical axis where the apex of each protrusion coincides with the vertical axis. These two protrusions are hereafter referred to as the central protrusions 331.

Each of the central protrusions 331 are flanked by two additional protrusions, one on either side of the central protrusion in the positive and negative horizontal axis directions. These four protrusions are hereafter referred to as the edge protrusions 332. In between each of the four edge protrusions 332 and their respective central protrusions 331 is fluting that curves towards the driver, making four fluting pieces 334 that are identical in shape and size.

The two sets of three protrusions are distanced from each other such that the vertical axis length of the aperture is larger than its horizontal axis length. The two edge protrusions 332 located on a first side of the vertical axis are joined by a curve that bends towards the origin from one protrusion and extends back towards the second protrusion beyond the horizontal axis. Similarly, another connecting curve joins the other two edge protrusions 332 located on the opposite side of the vertical axis to maintain symmetry. The two connecting curves make the aperture appear pinched near the origin with the apexes of the curves coincident with the horizontal axis. The two connecting curves form the boundaries of the last two pieces of fluting 335. The boundaries of the flutings 335 are defined by the four edge protrusions 332. These two flutings 335 are identical in shape and size and are larger than the four flutings 334 described previously. The elongated flutings defined by the edge protrusions 332 and their connecting curves enable the aperture shape 340 to be longer in the vertical direction than in the horizontal direction.

Due to the symmetrical nature of the aperture, the four edge protrusions 332 are identical in shape and size (with two different orientations) and the two central protrusions 331 are identical in shape and size and face opposite directions. Similarly, the four flutings 334 defined by the edge protrusions 332 are identical with different orientations and the two elongated flutings 335 are identical and symmetric about the vertical axis.

It can be seen that there are a large number of possible aperture shapes available for the purpose of changing the coverage pattern of a speaker. The three embodiments described above may decrease the directivity index of the speaker, thereby increasing the coverage pattern in the horizontal direction due to their shared elongated shape and orientation. The elongation of the embodiments with their longer axis aligned with the vertical axis allows the coverage pattern of the woofer to match that of the horn in the horizontal plane. This allows the directivity of the woofer and horn to be closer in the crossover region. In this way, it can be seen that the number of protrusions, number of flutings, and general aperture shape may be modified without deviating from the scope of this disclosure. The three embodiments described above provide examples of aperture shapes that may be used in speaker systems to maintain proper elongation and orientation to provide matching coverage patterns.

The spacing and size of protrusions may be determined according to each speaker system and the target directivity so as to match the horizontal coverage patterns of the woofer and horn in the present embodiments, or the coverage patterns of any other set of speakers according to other systems. Additionally, the protrusion spacing and size may depend on to what degree the standing waves (resonances) within the speaker are smeared or broken by the protrusions. From these factors, it can be seen that the particular aperture shape may be selected based on the specific speaker system used.

The aperture may be attached to different types of speakers. In the embodiments described above, the aperture has been described as attaching to a conventional driver such as a woofer or mid-range driver. However, the aperture may be attached to a number of other drivers such as subwoofers or tweeters, or any other driver that emits a range of frequencies. Furthermore, the aperture may be placed over other driver types besides conical dynamic loudspeakers. In addition, the aperture may contain any number of protrusions and flutings. To direct sound energy towards one side so the speaker is biased, an odd number of protrusions may be used, thereby producing asymmetrical sound. To produce symmetrical sound coverage, an even number of protrusions may be used.

In addition to being attached to different types of speakers, the aperture may be utilized with any type of speaker system. The aperture has been described with relation to a portable PA system, but it is understood that the aperture may be attached to a different type of system with similar benefits and effects as those described previously. Since the aperture is a simple structure with no power source, electrical wiring, or programming needed, it can be seen that the aperture can be rigidly attached to any driver with little difficulty.

The aperture may be fitted with a number of ribs to stiffen the aperture shape, in particular the curved fluting. Depending on the thickness of the aperture, the curved fluting may be susceptible to fracture due to vibrations or an impact load. The ribs may help strengthen the curvature and entire aperture. The ribs may radiate from the center of the aperture to the outermost edges to maintain the symmetry of the aperture and to uniformly stiffen the material. The ribs may increase the durability of the aperture and may not change or affect the sound directivity of the speaker to which the aperture is attached. In some embodiments, the ribs may extend and/or be present only in areas in which material resides (e.g., the aperture frame 350). In other embodiments, the ribs may extend along a diameter of the aperture frame 350, between two or more fluting pieces 334, and/or between two or more protrusions 331. For example, one or more ribs may extend between regions and/or points of two or more fluting pieces, the regions and/or points extending furthest toward a center of the aperture shape with respect to other regions and/or points of that flute. Similarly, one or more ribs may extend between regions and/or points of two or more protrusions, the regions and/or points extending furthest away from a center of the aperture shape with respect to other regions and/or points of that protrusion.

Figure 4:
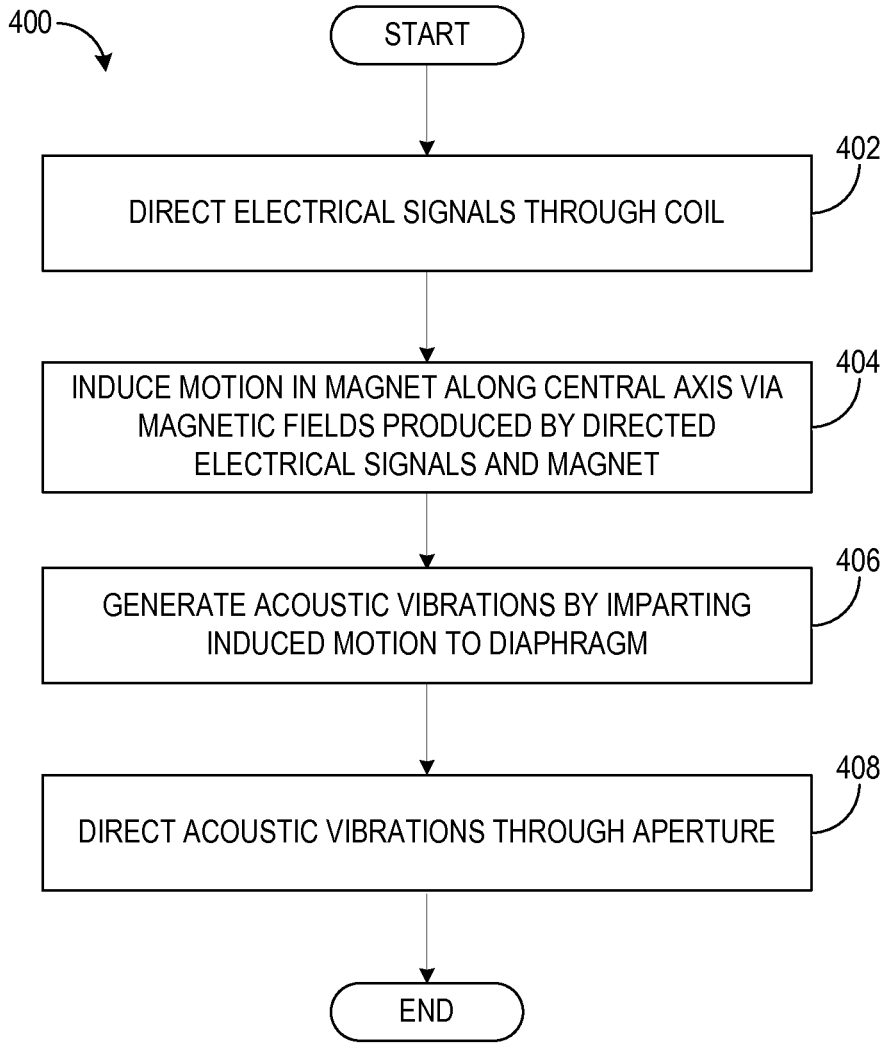
FIG. 4 is a flowchart of a method for driving a loudspeaker in accordance with one or more embodiments of the present disclosure.

Turning now to FIG. 4, a flowchart illustrating a method 400 for driving a loudspeaker having an aperture in accordance with embodiments of the present disclosure is shown. Loudspeakers 10 and 300, respectively shown in FIGS. 1 and 3 may be driven according to method 400, for example, though other loudspeakers may also be driven according to the method.

At 402 of method 400, electrical signals are directed to a coil. Next, at 404 of method 400, motion along a central (e.g., vertical) axis is induced in a permanent magnet. Particularly, magnetic fields arising from directed electrical signals propagating through the coil portions interact with the magnetic field emanating from the permanent magnet to induce motion in the magnet along the central axis. Induced magnet motion may be constrained to the central axis via a linear bearing, for example. The linear bearing may include a shaft embedded in a loudspeaker housing, with a sleeve in sliding contact with the shaft and coupled to the magnet.

Next, at 406 of method 900, acoustic vibrations are generated by imparting induced motion in the magnet to a diaphragm in the loudspeaker. This may be accomplished by conveying induced motion magnet to a coupler affixed to the magnet, and conveying this motion to the diaphragm via its connection to the coupler. In this manner, the diaphragm may vibrate and thus produce acoustic vibrations responsive to the electrical signals applied to the dual coils. Finally, at 408 of method 400, the acoustic vibrations are directed through the aperture to an environment of the loudspeaker.

While FIG. 3 illustrates a general embodiment of a speaker for a PA system without many geometrical details, FIGS. 8 to 12 each show different views and cross-sections of a particular, detailed embodiment of speaker 300 of FIG. 3. Speaker 800 illustrated in FIGS. 8 to 12 is drawn to scale, but it is understood that the dimensions may vary depending on the size of the drivers used and other speaker system factors. Also, FIGS. 8 to 12 show many of the same features from different angles, and as such those same features will be identically labelled in each figure.

Figure 8:
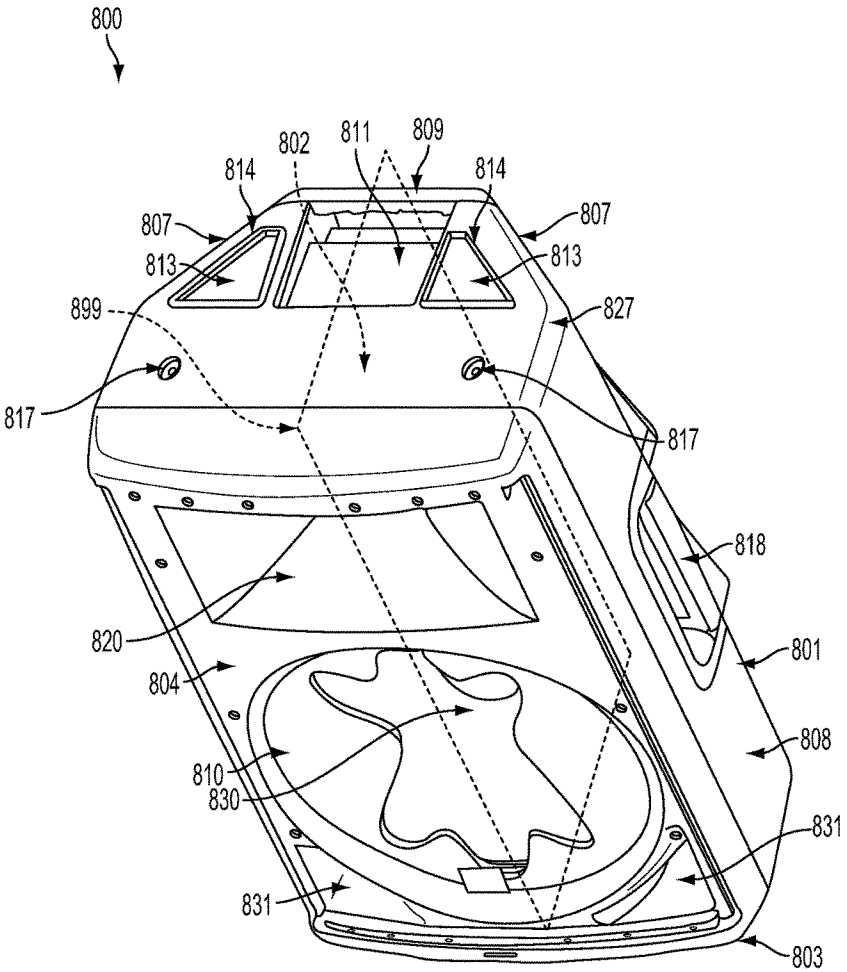
FIGS. 8-12 show different views of a detailed two-way portable pro audio speaker in accordance with one or more embodiments of the present disclosure.

Referring to FIG. 8, the speaker comprises a housing 801 to which aperture 810, horn 820, woofer 830, and other components are mounted. The speaker 800 is symmetrical about a vertical plane 899 that bisects the center of the horn 820, woofer 830, and aperture 810. The housing 801 is of a generally irregular hexagonal prism shape with parallel surfaces. It is noted that all exterior surfaces are also generally planar.

A top surface 802 and bottom surface 803 of housing 801 share substantially equal shapes, the shape being a square with two triangular notches 807 removed from two corners. The housing 801 includes a front surface 804 that has a generally rectangular shape. On the front surface the aperture 810 is fixed with the woofer 830 extending directly behind the aperture into the depth of the speaker housing 801. The horn 820 is also fixed to the front surface 804 and is positioned above aperture 810 such that the horn 820 is closer to the top surface 802 than the aperture 810 and woofer 830.

On the front surface 804 and below the aperture 810 two generally triangular cavities 831 are formed that extend into the depth of the speaker housing 810. The curvatures of the longer sides of cavities 831 are defined by the circular border of aperture 810. Cavities 831 and aperture 810 are separated by a uniform material thickness. It is noted that cavities 831 may be utilized as bass reflex ports, the function of which are to increase woofer efficiency by using sound from the rear of the woofer.

The top surface 802 contains two circular ports 817 symmetrically positioned on either side of plane 899. Bounded by the triangular notches 807 is a carrying handle 809 that defines the upper edge of top surface 802. Adjacent to the carrying handle 809 is a stepped recess 811 with a rectangular profile, the recess allowing a user's hand to easily grasp the carrying handle 809. Proximate to the stepped recess 811 on two sides are triangular features 813, also located on top surface 802. The periphery of the features 813 is defined by continuous ridges 814 that protrude away from the top surface 802. Another carrying handle 818 is positioned on a side surface 808, the carrying handle located midway between the top surface 802 and bottom surface 803. Due to the symmetry, a similar carrying handle (not shown) is attached to the surface opposite and parallel to surface 808.

The edges 827 that surround the periphery of the top surface 802 are filleted to smooth the intersecting edges between the top surface 802 and perpendicular surfaces such as side surface 808. Similarly, the edges (not shown) of the bottom surface 803 are filleted, along with any exterior surfaces where two or more surfaces meet.

Figure 9:
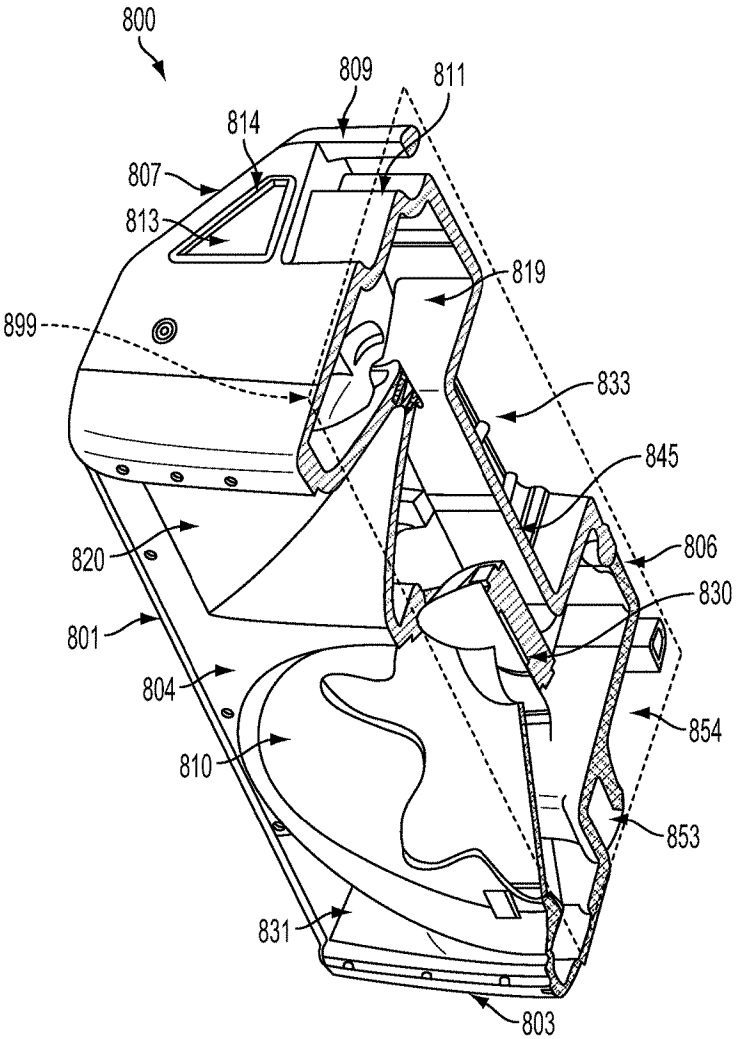

FIG. 9 shows the speaker 800 from the same angle as FIG. 8 but with a cross-sectional view along plane 899. The interior of the speaker comprises a hollow cavity 819, part of which may be designed for sound quality purposes. The cavity 819 is surrounded by material 845 that has a generally invariant thickness. The front of cavity 819 is partially defined by the rear geometries of the woofer 830 and horn 820 that face towards the interior of housing 801. The speaker housing 801 also contains a rear surface 806 which is parallel and opposite to the front surface 804. The rear surface 806 contains a centrally-positioned square hollow 833 that protrudes into the interior of the housing 801. The hollow 833 is surrounded by material 845 such that the hollow 833 is on the exterior side of the speaker housing 801 and is not part of the housing interior.

A generally cylindrical hollow 853 is formed on the center of bottom surface 803 that protrudes into the interior of the housing 801 in a similar fashion to the hollow 833. Another hollow 854 is also formed on the bottom surface 803 that projects towards the interior of the speaker housing 801. Hollow 854 has a generally rectangular shape and is adjacent to hollow 853 and closer to the rear surface 806. Cavities 831, if used as bass reflex ports, may form a direct connection with cavity 819 on the interior side of speaker housing 801. The connection would allow sound emitted from the backside of the diaphragm of woofer 830 to be carried through cavity 819 and emitted from speaker 800 via cavities 831. As illustrated, the aperture 810 may include material (e.g., forming an aperture frame as described above with respect to FIG. 3) having a thickness associated thereto. The thickness of the material of the aperture 810 may form a depth, or third dimension, associated with an opening in the aperture (e.g., the two-dimensional aperture shape 340 described above with respect to FIG. 3). In some embodiments, the thickness of the material of the aperture 810 may be substantially the same across the entire aperture. In other embodiments, the thickness of the material of the aperture 810 may vary, such that the aperture is thicker in some locations than others. For example, an outer periphery of the aperture 810 may be thicker than an inner portion of the aperture (e.g., material of the aperture located toward a center of the aperture). The outer periphery may have differing thicknesses along the circumference of the aperture 810. For example, the aperture 810 may be thicker at a top and/or bottom (e.g., in a first direction toward/away from the horn 820) and thinner at a left and/or right side (e.g., in a perpendicular direction to the first direction).

Figure 10:
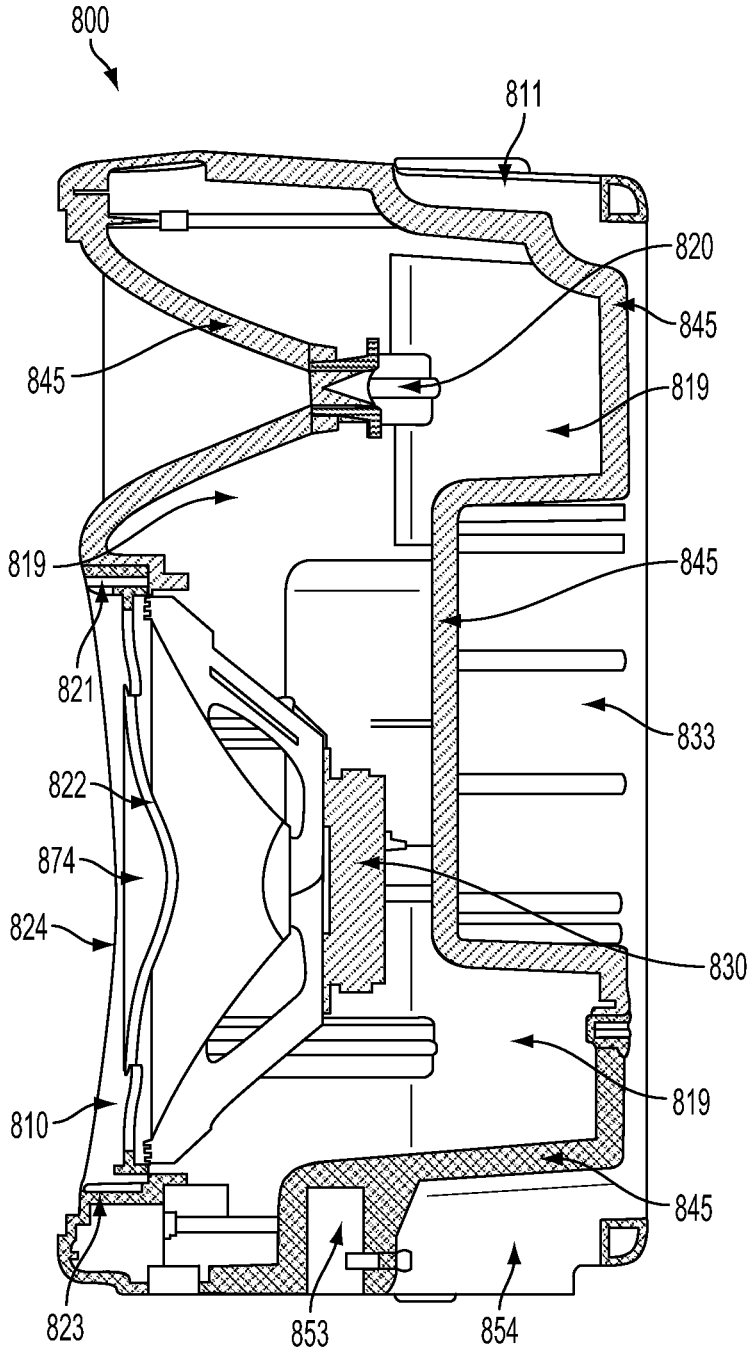

FIG. 10 shows the speaker 800 with the same vertical cross-sectional cut as FIG. 9 but from a side view. Note in this view the curvature of the fluting 334 and 335 of FIG. 3 is clearly illustrated as fluting 874 in FIG. 10. As illustrated, the fluting may extend inward relative to other regions of the aperture 810. For example, a portion of the aperture 810 (e.g., a peripheral portion) may abut and/or be flush with the material 845 of the housing 801 located along an outer circumference and/or periphery of the aperture 810. The peripheral portion may abut the material 845 of the speaker housing 801 along different planes, such as a horizontal and vertical plane perpendicular to one another. For example, a notch 821 may be provided in the housing that enables the aperture 810 to be installed (e.g., mounted, bolted, fixed, screwed, welded, and/or otherwise secured) in the housing 801. In some embodiments, the aperture 810 may be bolted or otherwise fixed along one plane (e.g., via a fixing mechanism inserted in a direction toward the woofer 830) and abut the other plane without being fixed thereto. Other portions of the aperture 810 (e.g., including the fluting 874) may extend into the housing 801. The extension may be achieved by a curvature of portions of the material of the aperture 810 and/or by a relative thickness of portions of the material forming the aperture 810. For example, portions of the aperture 810 that are in contact with the material 845 of the speaker housing 801 may be thicker than portions of the aperture 810 that are located toward a center of the aperture (e.g., the fluting 874). As the portions of the aperture 810 that are located toward a center of the aperture may be curved inward, toward the woofer 830, such portions of the aperture may extend further into the speaker housing 810 than the peripheral portions of the aperture 810, despite having a smaller thickness relative to the peripheral portions.

Portions of a rear face 822 of the aperture 810 (e.g., in a direction of the woofer 830 and an interior of the speaker housing 801) may be in face-sharing contact with the material 845 of the speaker housing 801 and/or portions of the woofer 830. Substantially all of a peripheral face 823 of the aperture 810 may be in face-sharing contact with portions of the speaker housing 801. A front face 824 of the aperture 810 may be non-uniform, as portions of the periphery of the aperture 810 and the fluting 874 may be curved inward toward the woofer relative to other portions of the periphery of the aperture 810.

Figure 11:
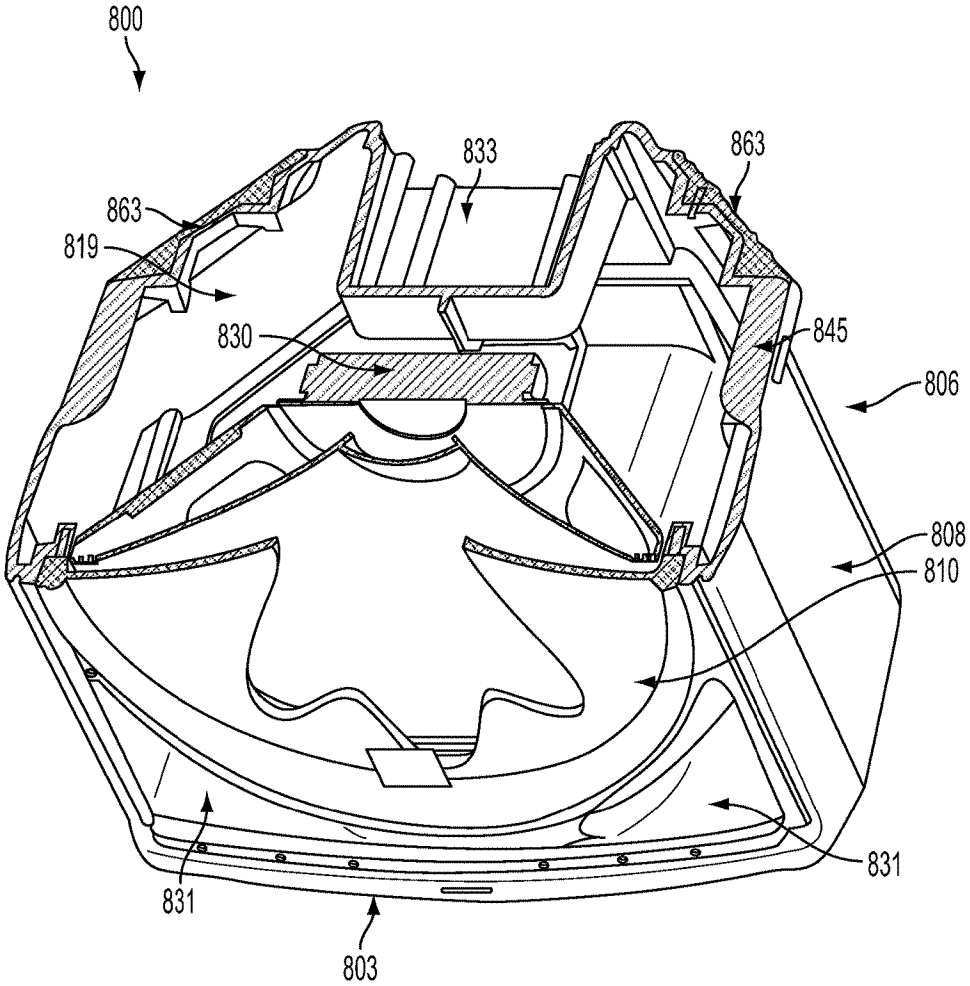
Figure 12:
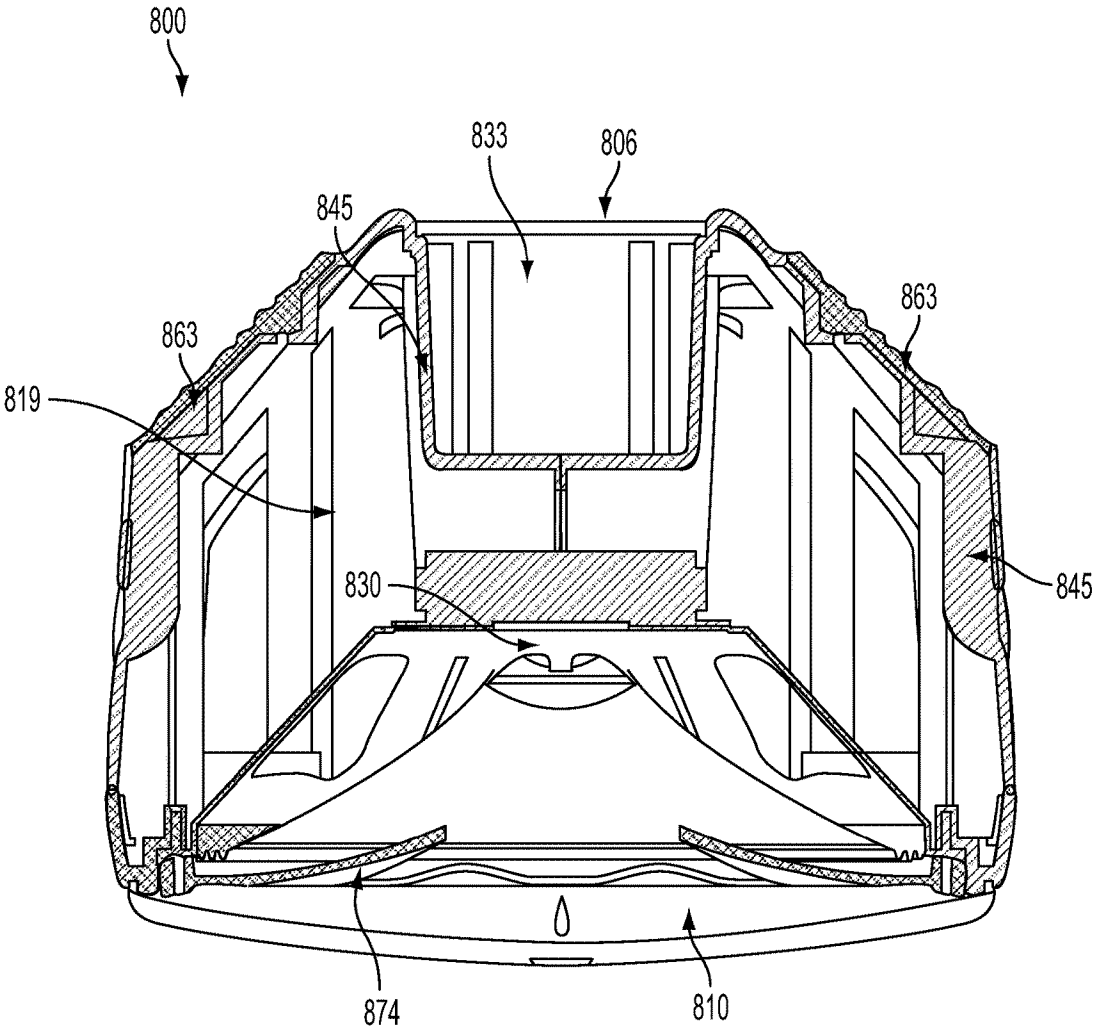

FIG. 11 shows the speaker 800 with a cross-sectional view along a horizontal plane. The plane cuts through the aperture 810 and woofer 830 hiding the upper half of speaker 800 from view. The thickness of housing 801 defined by material 845 can be seen along with more of the geometry of cavity 819. The surfaces defined by triangular notches 807 contain stepped structure 863 that may provide support for carrying handle 818 and opposite carrying handle not shown. Structure 863 connects the rear surface 806 of the speaker housing 801 and side surface 808 of the speaker housing 801 with a series of stepped edges as seen in FIG. 11. Symmetrically, the same structure 863 connects the rear surface 806 and opposite side surface (not shown). As can be seen along the cross-section of speaker 800, cavity 831 extends a distance into speaker housing 801. As illustrated, the aperture 810 may include an outer portion forming a ring of thicker material along a periphery of the aperture, and an inner portion forming an aperture frame of thinner material extending from a middle region of the thickness of the ring formed by the outer portion. While the outer portion may be in face-sharing contact with a portion of the speaker housing 801 and/or the woofer 830 along a rear face, a rear face of the inner portion may be spaced from the speaker housing 801 and/or woofer 830 (e.g. separated with an air gap). FIG. 12 shows the speaker 800 with the same horizontal cross-sectional cut as FIG. 8 but from a top view. The curvature of the fluting 874 toward the woofer 830 and the thickness differential between the portions of the aperture 810 is illustrated in more detail therein.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices, such as the speaker 300 of FIG. 3. The methods may be performed by executing stored instructions with one or more logic devices (e.g., processors) in combination with one or more additional hardware elements, such as storage devices, memory, hardware network interfaces/antennas, circuits, actuators, switches, etc. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. It is to be understood that example vehicle/user status information, driver profile characteristics, and other inputs and outputs to the system described above are exemplary and are not intended to be exhaustive. The following claims particularly point out subject matter from the above disclosure that is regarded as novel and non-obvious.

The invention claimed is:

1. A loudspeaker comprising:

an electromagnetic transducer including a diaphragm configured to generate acoustic vibrations;

an aperture positioned in front of the diaphragm in a direction of propagation of the acoustic vibrations, the aperture including an opening having one or more protrusions forming an opening shape having non-uniform edges, the aperture further comprising fluting, the fluting being smoothly curved without sharp corners; and a high frequency horn positioned above the diaphragm and configured to emit high frequency waves that do not pass through the opening;

wherein a directivity of the electromagnetic transducer matches a directivity of the high frequency horn in a crossover region.

2. The loudspeaker of claim 1, wherein one or more of the opening shape and a housing of the loudspeaker is wider in a vertical plane than a horizontal plane.

3. The loudspeaker of claim 1, wherein one or more of the opening shape and a housing of the loudspeaker is wider in a horizontal plane than a vertical plane, wherein the fluting is curved toward the diaphragm, and wherein the high frequency horn and the electromagnetic transducer are mounted in a common housing, spaced apart from one another.

4. The loudspeaker of claim 3, wherein the opening is longer in a first direction than a second direction perpendicular to the first direction, the first direction extending from the diaphragm to the high frequency horn.

5. The loudspeaker of claim 4, wherein the fluting is concave in a direction toward the diaphragm, and wherein a mouth of the high frequency horn is longer in the second direction than the first direction.

6. The loudspeaker of claim 5, wherein the one or more protrusions extend away from a center of the aperture and the opening, and wherein the fluting curves toward the diaphragm as the aperture is traversed from an outside edge of the aperture toward the center.

7. The loudspeaker of claim 1, wherein at least one of the protrusions includes a rounded edge.

8. The loudspeaker of claim 1, wherein at least one of the protrusions includes a straight edge.

9. The loudspeaker of claim 6, wherein the one or more protrusions includes an even number of protrusions arranged around a periphery of the opening.

10. The loudspeaker of claim 1, wherein the one or more protrusions includes an odd number of protrusions arranged around a periphery of the opening.

11. The loudspeaker of claim 9, wherein the one or more protrusions are arranged symmetrically around the opening with respect to a first, horizontal axis, and wherein the one or more protrusions comprise exactly six protrusions.

12. The loudspeaker of claim 1, wherein the one or more protrusions are arranged asymmetrically around the opening in a first plane.

13. The loudspeaker of claim 11, wherein the one or more protrusions are arranged symmetrically around the opening with respect to a second, vertical axis, the first axis being perpendicular to the second axis, wherein a first protrusion is spaced at a first distance from a second protrusion, the first protrusion adjacent to the second protrusion, and wherein the first protrusion is spaced at a second distance, different from the first distance, from a third protrusion, the first protrusion adjacent to the third protrusion.

14. A loudspeaker comprising:

an electromagnetic transducer including a diaphragm configured to generate acoustic vibrations;

an aperture positioned in front of the diaphragm in a direction of propagation of the acoustic vibrations, the aperture including a single opening that is symmetric about two perpendicular axes, the opening including one or more protrusions extending from a center of the opening, where the opening is longer along a first perpendicular axis of the two perpendicular axes than along a second perpendicular axis of the two perpendicular axes; and a high frequency horn spaced away from the diaphragm and the opening, the high frequency horn being centered on the first perpendicular axis;

wherein the aperture comprises a first region and a second region, the first region being planar and adjacent to an outside edge of the aperture, the second region curving smoothly toward the diaphragm as the aperture is traversed from the outside edge toward the opening, the second region located adjacent to the opening.

15. The loudspeaker of claim 14, wherein the center of the opening is defined by an intersection between the two perpendicular axes, where the aperture includes a smooth transition between the first region and the second region, and where the high frequency horn is longer along a direction of the second perpendicular axis than the first perpendicular axis.

16. The loudspeaker of claim 14, wherein the one or more protrusions comprise curves that have rounded intersections, wherein the second region smoothly curves out of the plane of the first region, and wherein the aperture includes no sharp corners.

17. The loudspeaker of claim 14, wherein the opening symmetrically curves along at least one angled line that passes through the center of the opening, wherein the second region is concave in a direction toward the diaphragm, and wherein a directivity of the high frequency horn matches a directivity of the electromagnetic transducer in a crossover region.

18. The loudspeaker of claim 14, wherein the one or more protrusions comprise exactly six protrusions, wherein two of the six protrusions are arranged symmetrically at opposing ends of the opening with respect to the center of the opening and aligned along the first perpendicular axis.

19. A loudspeaker comprising:

an electromagnetic transducer including a diaphragm configured to generate acoustic vibrations;

an aperture positioned in front of the diaphragm in a direction of propagation of the acoustic vibrations, the aperture including a single opening that is symmetric about two perpendicular axes, the opening including six protrusions extending from a center of the opening, three of the six protrusions positioned on each side of a horizontal axis through the center of the opening, and a first and a second central protrusion of the six protrusions positioned along a vertical axis through the center of the opening, where an apex of each of the first and second central protrusions coincides with the vertical axis; and a high frequency horn positioned above the diaphragm and configured to emit high frequency waves that do not pass through the opening, the high frequency horn oriented such that a long axis of the high frequency horn is perpendicular to a long axis of the opening along a front side of the loudspeaker;

wherein the aperture further comprises six fluting pieces located between the six protrusions, the fluting pieces curving smoothly toward the diaphragm as the aperture is traversed from an outer edge of the aperture to the opening.

20. The loudspeaker according to claim 19, wherein each protrusion of the six protrusions has a curved shape with an apex, the apex being a point of the protrusion being furthest away from the center of the aperture, wherein the apexes of the first and second central protrusions are each at a first distance from the center and aligned along the long axis of the opening, wherein the aperture includes third, fourth, fifth, and sixth protrusions of the six protrusions each having apexes at a second distance from the center, the second distance less than the first distance, wherein the third and fourth protrusions are adjacent to the first central protrusion, the apexes of the third and fourth protrusions each being at a third distance from the apex of the first central protrusion, wherein the fifth and sixth protrusions are adjacent to the second central protrusion, the apexes of the fifth and sixth protrusions each being at the third distance from the apex of the second central protrusion, wherein the third and fifth protrusions are adjacent, wherein the fourth and sixth protrusions are adjacent, wherein a distance between the third and fifth protrusions is greater than the third distance, and wherein a distance between the fourth and sixth protrusions is greater than the third distance.

* * * * *